US005641398A

United States Patent [19]

Huber et al.

[11] Patent Number: 5,641,398

[45] Date of Patent: Jun. 24, 1997

[54] DEVICE FOR REMOVING SCREENED MATERIAL FROM A LIQUID FLOWING IN A FLUME

[75] Inventors: Hans Georg Huber, Berching; Reinhold Fischer, Forchheim, both of Germany

[73] Assignee: Hans Huber GmbH Maschinen und Anlagenbau, Berching, Germany

[21] Appl. No.: 540,316

[22] Filed: Oct. 6, 1995

[51] Int. Cl.[6] ..... B01D 35/02; E02B 5/08; E03F 5/14

[52] U.S. Cl. ..... 210/158; 210/159; 210/161; 210/162; 210/160; 210/393; 210/394; 210/396; 210/400; 210/403

[58] Field of Search ..... 210/158, 159, 210/160, 161, 162, 403, 400, 393, 394, 396

[56] References Cited

U.S. PATENT DOCUMENTS 5,102,536 4/1992 Wiesemann .

FOREIGN PATENT DOCUMENTS 0630674 12/1994 European Pat. Off. .
3217982 1/1983 Germany .
3420157C1 1/1986 Germany .
3630755C2 8/1988 Germany .
9113761.6 11/1991 Germany .
4213847A1 10/1992 Germany .
4136401 1/1993 Germany .
9303867 5/1993 Germany .
4302849A1 8/1993 Germany .
4314673 5/1994 Germany .

*Primary Examiner*—Thomas M. Lithgow
*Attorney, Agent, or Firm*—Thomas, Kayden, Horstemeyer & Risley

[57] ABSTRACT

A device for removing floating and suspended debris from a liquid flow passed through a liquid flow flume (3) is disclosed, the device including a separator (9) positioned within the liquid flow flume at an angle with respect to the flume and extending across the path of the liquid stream for collecting floating and suspended debris thereon. An elongated conveyor assembly (10) having an elongated tubular housing (20) with a first conveyor portion (11) and a second conveyor portion (12) is also provided as a part of the device. The first conveyor portion of the conveyor assembly is positioned within the separator and extends therefrom, the first portion of the conveyor assembly, as well as the conveyor assembly, being independently supported with respect to, and without being formed as a part of, the separator. An intake chute (18) is defined in the first conveyor portion, and is positioned generally below, and is generally aligned with, a separation device (24) positioned within the separator for loosening debris collected on the separator and directing the debris toward the intake chute. The second conveyor portion has a discharge chute (22) formed at its end opposite the end thereof connected to the first conveyor portion. Debris is collected on the separator from liquid passed therethrough, directed toward and into the intake chute by the separation device, and then moved out of the separator and discharged outside of the flume by the conveyor assembly.

33 Claims, 8 Drawing Sheets

DEVICE FOR REMOVING SCREENED MATERIAL FROM A LIQUID FLOWING IN A FLUME

FIELD OF THE INVENTION

The invention relates in general to a device for removing screened material from a liquid flowing in a flume. More particularly, this invention relates to a device used to remove floating and suspended debris from a liquid passed through a liquid flow flume adapted for use in sewage-treatment plants, but which can also be employed in the textile industry, in slaughter houses, poultry farms, tanneries, and the like.

BACKGROUND OF THE INVENTION

An example of a prior art device for removing debris from a liquid passed through a flume is disclosed in DE 42 13 847 A1. As in most of the prior art, a significant structural connection exists between the separator and the conveyor, the conveyor screw having a double function. The conveyor screw, as a part of the separator, serves to remove the screened materials from, and to clean, the separation area. On the other hand the conveyor screw, as a part of the conveyor, fulfills a transfer function. With respect to the art, in which the conveyor screw is only part of the conveyor, there exists a spatial relationship between the separator and the conveyor wherein the discharge point for the filtered material collected on the separation area and the intake chute of the conveyor overlap at least partially in vertical projection. In addition, the conveyor housing is connected in fixed manner with parts of the separator and serves to support a common drive for both the separator and the conveyor. In one embodiment, the axis of the separator is positioned parallel to and at a distance from the axis of the conveyor, the axis of the conveyor being positioned below the axis of the separator. However in this embodiment the device is still equipped with a common drive for both the separator and the conveyor, making gearing necessary for power distribution and for different rates of revolution and/or for different directions of rotation. In addition, in this version of the prior art there exists a physical or structural relationship between the separator and the conveyor, for example elements of the separator are supported on the housing of the conveyor.

From DE 91 13 761 U1 it is known to position the rotating axes of the conveyor screw on the one hand, and of the separator on the other hand, at a distance with respect to each other, especially parallel to one another, and preferably orientated one about the other. Here again there is still a common drive and distribution gearing for the conveyor screw of the conveyor and for the separation area of the separator in form of a perforated grate or filter.

DE 36 30 755 C2 shows a device having a separation area in the form of a grid composed of a plurality of grating bars and driven in rotation. The liquid enters the separation area through an open face defined therein and flows therethrough in the liquid flow direction within the flume. The material to be screened is deposited on the inner surface of the cylindrical separation area and is moved upwardly by the rotation of the separation area. A stripper is provided as a removal device to remove the deposited material from the separation area, the stripper extending at least partially into the gaps between the grating bars. A conveyor is positioned coaxially with the axis or the separator. The conveyor, a screw conveyor device, removes the material deposited on the separation area and conveys the screened material in the direction of the liquid flow in the flume at an upwardly inclined angle with respect to, and out of the flume. The material is discharged at a discharge collection point. The cylindrical separation area of this device is supported on the housing of the conveyor. The separation area of the separator and the conveyor are thus a common unit. This unit is mounted in the flume in an inclined manner, where the angle of the common axis of the separator and conveyor with respect to a horizontal plane may be varied within limits. Depending on the installation conditions it is necessary to construct the separation area and the conveyor with respect to each other, and to then manufacture, deliver and install both the separator and conveyor as a single unit. Different devices must be manufactured depending on the different width of the flumes, discharge height, and so on.

A similar device is disclosed in DE 34 20 157 C1. Here the separation area, for example a sieve, or grating, and the conveyor are a single structural unit having a coaxial arrangement of their axes with one another. The separation area is connected to the shaft of the screw conveyor device, and is indirectly driven through this connection making only one motor necessary for driving both the separation area and the conveyor screw.

The prior art devices for the removal of material to be screened out of a liquid flowing in a flume are equipped with a separation area which is either located in a fixed position or driven in rotation. A fixed separation area should not be designed cylindrically nor to continuously extending around the circumference the separation area, but may be provided with a sectional gap thereof positioned in the region above to the liquid level in the flume. However, aside from these devices, the direction of development in this field of devices is directed to the fact that the separator, inclosing a separation area, on the one hand, and the conveyor, on the other hand, always form a single or common unit, in which there is not only a spatial relationship of the parts to one another, but there is also a functional and structural connection of these parts to each other. This is especially the case where the shaft or the separator is coaxial with shaft or the conveyor screw. In addition, the conveyor is always located in the flume so that it conveys the screened and removed material in the flow direction of the liquid inclined upwardly, with respect to the flume, up to a discharge point. Advantageously, the open inflow face of the cylindrical separation area here is obstructed to a minimal extent by the conveyor. A large portion of the conveyor housing in which an intake chute is defined for receiving the material to be discharged from the separator is located above the liquid level of the flume. The disadvantage of the prior art devices consists of the fact that for each installation, in which the device is used, these units must be separately manufactured. Even for flumes of the same width but different positioning angles and the same depositing height the overall length of the device must be varied.

SUMMARY OF THE INVENTION

It is an object of this invention to provide a device of the type described above, in which the separator and the conveyor have a decreased structural dependence on each other, thus making it possible to universally use the device with its component assemblies in different angled conditions of the axes of the separator and the conveyor, and/or with respect to to different installation conditions.

This object is achieved by providing a separator with a separation area and a conveyor constructed as separate units and equipped with separate, independant drives. The conveyor extends through the interior of the separation area and transfers the collected material and debris in the direction opposite to, i.e, against, the flow direction of the liquid in the flume.

The invention starts with the idea of separately fabricating a separator, i.e., filter, having a separation area defined therein and a conveyor assembly so that there is no structural connection between these elements, but only a spatial relationship between the two elements as it is necessary for the dropping discharge of the material from the separator into the intake chute of the conveyor, and from there to a discharge point outside the flume. The intake chute of the conveyor need only be positioned in a spatial relationship to the separation area. This makes the coaxial arrangement of the two separate construction units unnecessary and opens the possibility for the manufacture of the separator on the one hand and of the conveyor on the other hand, as separate assemblies, the device being assembled from these two different assemblies as one device, resulting in a device adapted to the specific jobsite and the installation conditions.

The angled position of the axis of the conveyor may be mounted independently from the angled position of the axis of the separator, wherein the advantage of this axial displacement may be used. This new device is designed not only contrary to the trend of development of the prior art of this type, but a new generation of devices for removing screened material is created which differs from the known devices in that the transport direction of the filtered material moved by the conveyor may be opposite to the normal conveying direction. More particularly, the transport direction is not in the same direction as the flow direction of the liquid in the flume, but against the flow.

The conveyor assembly is composed of two separate conveyor portions arranged and connected to one another in an angled relationship with respect to each other. The first conveyor portion serves for the horizontal transfer of the screened material and the second conveyor portion is provided for its vertical transfer of the material. Such a conveyor advantageously has a short length in the flow direction of the liquid in the flume. The overall length of the device is also decreased. Thus, the new device may also be used in narrow installation conditions. Different discharge heights using the same device may be attained by varying the angle of the axis of the conveyor accordingly. These possibilities of variation are of course limited by the geometry of the inclined positioning of the axis of the separator. On the other hand, the second portion of the conveyor provides for the vertical transport of the material does not need a driven conveyor screw, making it possible that this portion will consist of a tube which can be lengthened or shortened by adding or removing tube sections, when the discharge height must be varied. This portion of the conveyor may extend in a generally vertical manner out of the flume, or may be upwardly inclined with respect to the axis of the first conveyor portion.

The first and second portions of the conveyor are separate units, constructed to be connected to each other. The conveyor portions may be connected via an angled or arcuate tube section and fastened together by bucted flanges. Depending on jobsite conditions, different designs and prefabricated conveyor portions may be constructed and designed.

The spatial relationship between the separator and the conveyor exists when the intake chute of the conveyor for the collected material directed into the intake chute from the dropping point or region of the separator must be located below the dropping point so that the material falls downward in the intake chute. This avoids the transfer of these materials more than once.

The housings of the two portions of the conveyor may be connected to each other at an angle in the range of from about 60° to 90° inclusive, wherein an arcuate tube section, a T-piece, a branch or the like is provided between the housings of the two conveyor portions. It is especially easy to choose this angle to be 90°. It is even possible to position the first conveyor portion so that is is not inclined, but rather is horizontally positioned, resulting in the second conveyor portion being arranged vertically or inclined at an angle to the side of the flume. The conveyor assembly may be mounted at different angled positions of the flume with respect to the separator, depending on the orientation and inclination of the axis of the separator. As far as the connecting piece for the two conveyor portions is concerned, they must have a common diameter for their respective housing sections. Standardization is made possible through the use of flanged tube/housing sections.

The conveyor screw is located at least partially in the housing of the first conveyor portion, i.e. in the portion thereof extending substantially through the interior of the separation area. The pressure acting on the conveyed material may be used to transport the collected debris through the second conveyor portion also. A compaction effect of the material thus occurs, and the traveling time of the debris in the second conveyor portion is thus increased.

By the physical and functional separation of the separator from the conveyor assembly, it is possible that the axis of the first conveyor portion will be arranged in an eccentric and/or angled manner with respect to the axis of the separation area. A concentric arrangement is also possible. However, the first conveyor portion may be located in a region above the axis of the separator and parallel to the axis of the separator, thus resulting in a reduced dropping height for the material from the separator to the intake chute of the conveyor. With this arrangement a further advantage arises, which is that the overlapping of the first conveyor portion and the separator in their common axial direction is shorter, thus shortening the overall length of the device in the flow direction of the liquid. In addition, the possible angled positions of the conveyor, i.e., different angles of its axis, has the further advantage that the drive motor needed to drive the conveyor screw may be mounted above the maximum level of the liquid in the flume and at a shorter distance from the separation device within the separator. The conveyor assembly extends contrary to the flow direction of the liquid in the flume and partly through the liquid, but with only a small part of the open inflow face of the separator is obstructed, with the result that problems in the use of the separator are minimized.

The motor for the drive of the conveyor screw in the first conveyor portion may be mounted on top of the first conveyor portion at the end thereof oriented in the flow direction of the liquid. However, this extension in the flow direction is relatively short.

A washing device for the screened material dropped into the intake chute by the separation device may be provided in the region of the intake chute of the conveyor, the washing device comprising a plurality of nozzles for spraying liquid. The nozzles for the liquid may be positioned in the region of the intake chute as well as in the region of the bottom of the housing of the first conveyor portion. This makes it possible to agitate and ringe the dropped and screened material to remove and disintegrate any organic substances which should remain in the liquid. The material conveyed by the conveyor is thus cleaner and may be discharged more easily without the annoyance caused by a bad smell or odors at a dumping ground. The housing needed for the first conveyor portion also acts to house the washing device.

By separating the separator and the conveyor assembly from each other, a plurality of possibilities for the design of the separator and the separation area, respectively, are opened. The separation area may be arranged in a fixed manner and a driven separation device may be provided for removing and dropping the screened material toward the intake chute. Conversely, the separation area may be driven and a fixed separation device may be provided for removing and dropping the screened material into the conveyor intake chute. The driven separation area can be designed cylindrically, for instance as a cylindrical or filter sieve basket or drum, or made from grating bars or the like. On the other hand the separation area may consist of a driven sieve band, an endless chain conveyor of grating bars or the like linked together, which is guided by rollers, drums, guiding plates or the like positioned in the flume. Advantageously, this device may also have a polygonal separation area adapted to the cross-section of the flume, for example a V-shaped cross-section, resulting in higher liquid flow rates even at low liquid levels.

The second conveyor portion of the conveyor assembly used for compaction purposes may comprise a conical section with a reduced diameter extending toward the discharge chute formed at the end thereof. Thus, a compaction effect is created for the screened and conveyed material.

In general, it is sufficient to locate the conveyor screw only in the region of the first conveyor portion. A second conveyor screw may also be provided in the housing of the second conveyor portion, driven by a motor located in the region of the discharge chute. In this case the conveyor needs two motors, but they may be separately controlled for different running times adapted to each other making the pressing or compression of the material possible.

BRIEF DESCRIPTION OF THE DRAWINGS

Preferred embodiment versions of the device are illustrated in the following drawings, which show in.

DETAILED DESCRIPTION

Figure 1:
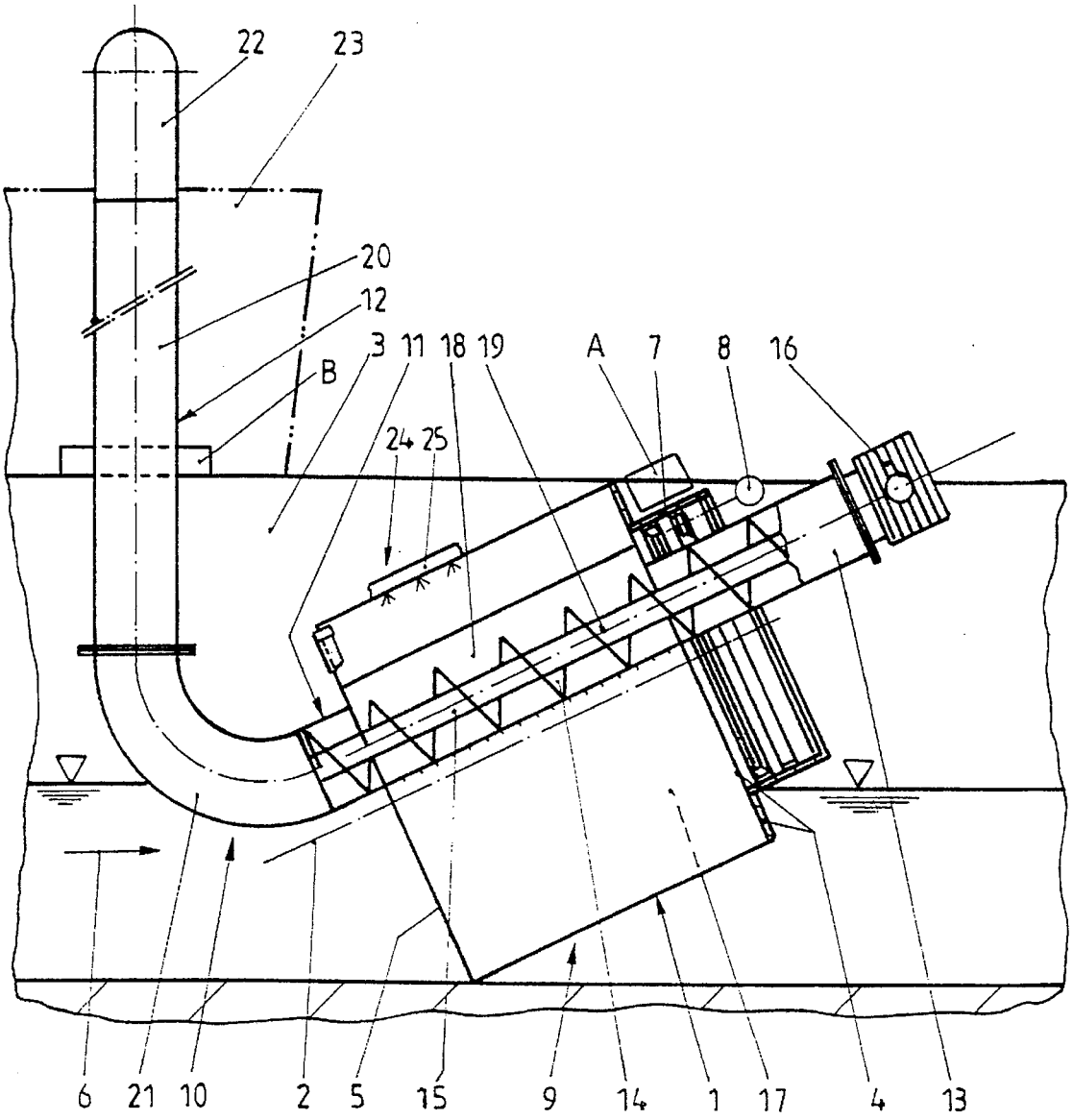
FIG. 1 a schematic side elevational view of a first embodiment of the invention, FIG. 2 an end view of the device of FIG. 1, FIG. 3 a schematic side elevational view of a second embodiment of the invention, FIG. 4 an end view of the device of FIG. 3, FIG. 5 a schematic side elevational view of a third embodiment of the invention, FIG. 6 an end view of the device of FIG. 5, FIG. 7 a schematic side elevational view of a fourth embodiment of the invention, FIG. 8 a schematic elevational side view of a fifth embodiment of the invention, FIG. 9 a cross-section along line IX—IX of FIG. 8, FIG. 10 a cross-section along line X—X of FIG. 8, showing a sixth embodiment, FIG. 11 a detail of the cross-section of FIGS. 9 and 10, and FIG. 12 an end view of the part of the separation area of a chain of grating bars of FIG. 11.
Figure 2:
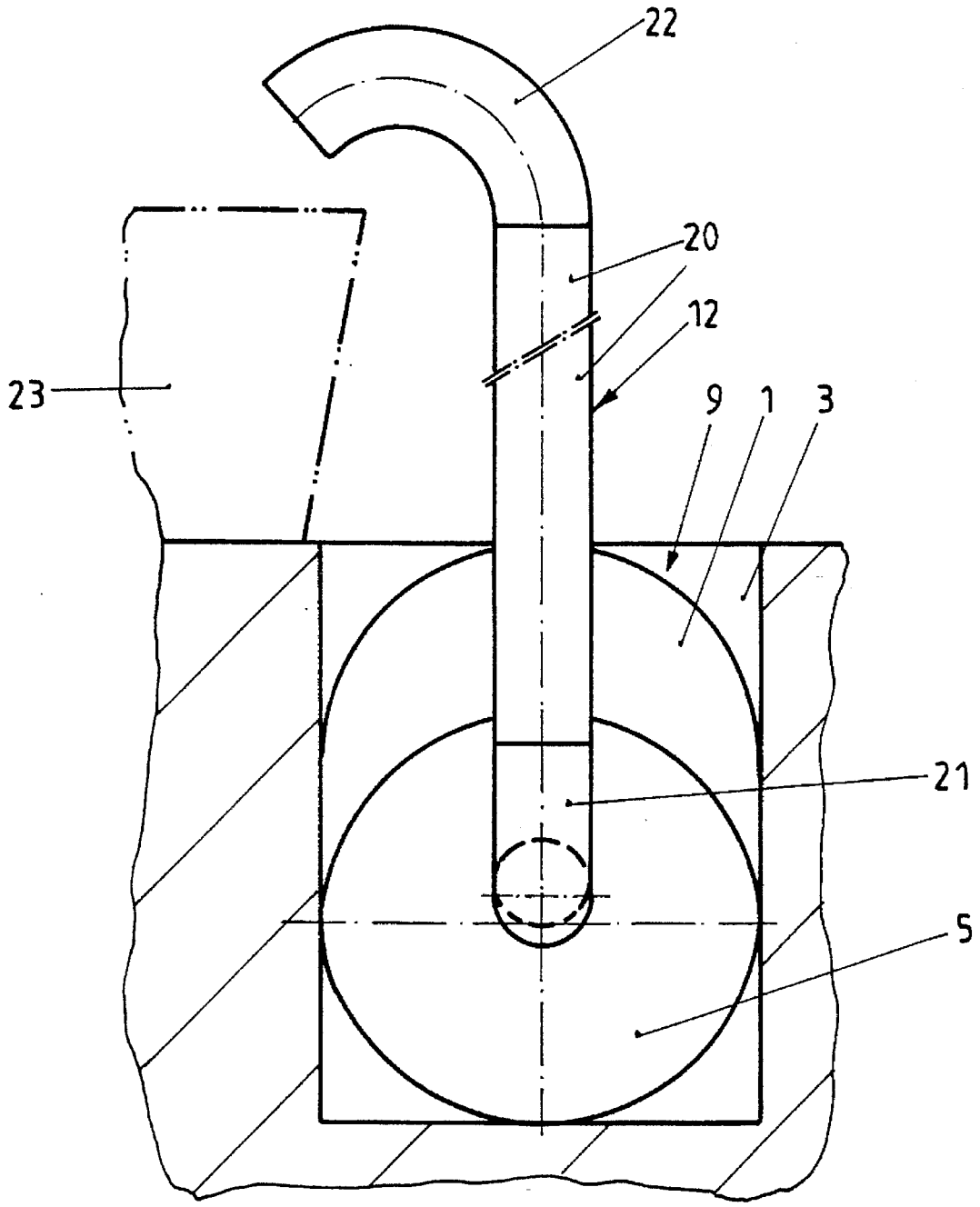

Referring now to the drawings in which like reference numerals indicate like parts throughout the several views, the device shown in FIGS. 1 and 2 comprises a separation area 1 having a cylindrical shape, which may have the form of a driven perforated grating. The separation area 1 is positioned in an inclined manner in a flume 3 with its axis 2 being inclined at an angle of about 25°. The width of the flume 3 is the same as the diameter of the separation area 1. On its upper end the separation area 1 is provided with a face wall 4 being at least partially closed. On the lower end of the separation area 1 an open face 5 is provided so that the liquid with the material to be screened therefrom may enter the interior of the separation are 1 in the direction of liquid flow shown by arrow 6.

Separation area 1 has a continuation 7 supported by the closed face wall 4. The continuation 7 serves for mounting a continental drive with motor 8. Thus, details of this drive, including motor 8, are not described in greater detail herein. It is important to recognize that a separator 9, comprised of these parts, is disclosed herein as a separate unit constructed separately and apart from conveyor assembly 10. Axis 2 of separator 9 may be positioned in an inclined manner in the flume 3 also at different angles from that. Frame elements A supporting the driven separation area 1 and bridging the flume 3 are not shown in detail for clarity of the drawings.

In addition, a conveyor assembly 10 is provided, constructed as a separate construction unit and not structurally connected to the separator 9. A frame B supports the conveyor assembly 10 and bridges the flume 3 independant from frame elements A. The conveyor assembly 10 comprises a first conveyor portion 11 and a second conveyor portion 12. The conveyor portion 11 has a hollow, elongated, and tubular housing 13, in which a shaft 15 with a conveyor screw 14 is rotatably supported. The shaft 15, and thus the conveyor screw 14, is driven by a motor 16 and a gear reducer or transmission (not illustrated), if needed. Motor 16 is positioned on the housing 13 at the end portion of the first conveyor portion 11 looking in the direction of flow according to arrow 6. The housing 13 of this conveyor portion 11 extends in the opposite direction to the flow direction of the liquid in the flume 3, according to arrow 6 through the interior 17 of the separator 9 and is surrounded by the separation area 1. Housing 13 has an intake chute 18 with angled sidewalls (not illustrated) for the screened material thrown off or dropped from separation device 24 positioned within the separator 9. The screened material is directed toward this intake chute 18 by the separation device. Accordingly, the first conveyor portion 11 is positioned with intake chute 18 with respect to the loosening area, i.e., separation device 24, of the screened material from the separation area 1 so that the materials fall completely into intake chute 18. This is the only requirement for the spatial arrangement of construction units with respect to each other, i.e. of the separator 9 with respect to conveyor assembly 10. The bottom of housing 13 of the first conveyor portion 11 is provided with a plurality of openings, perforations or the like (not illustrated) located above the level of the liquid in flume 3, as illustrated in FIG. 1.

The first conveyor portion 11 with its axis 19 is located in an eccentric and parallel manner with respect to the axis 2 of the separator 9, both axis 2 and axis 19 extending in a common longitudinal direction parallel to one another. Axis 19 is arranged on a higher level than axis 2, thus a smaller dropping height of the screened and thrown-off material above the intake chute 18 results. On the other hand, motor 16 needs only to be located on a short part of the first conveyor portion 11 advantageously making the overall length of the device relatively short. Thus, the first conveyor portion 11 also has a relatively short length extending in the flow direction of arrow 6 and serves to horizontally transport the collected screened material out of the separation device 9.

The first conveyor portion 11 may also be located at a different angle with respect to the axis 2 of the separator 9 than that shown. Axis 2 and 19 may be positioned with respect to each other parallel in a concentric or eccentric manner, or even not parallel to each other at all but at an angled relationship with respect to one another. Thus, a large number of possibilities are opened. For example, while it is intended that separator 9 will be longitudinally angled with flume 3, first conveyor portion 11 may extend out of separator 9 at an angle thereto, as well as with respect to flume 3.

The second conveyor portion 12 serves to vertically transport the collected screened material, and comprises a housing 20 in the form of a hollow tube. Housing 13 of the first conveyor portion 11 is connected with the housing 20 of the second conveyor portion 12 via arcuate tube section 21 bridging an angle of approximately 65°. At its upper end, housing 20 has a discharge chute 22 for discharging the material into a separately provided container 23.

Figure 4:
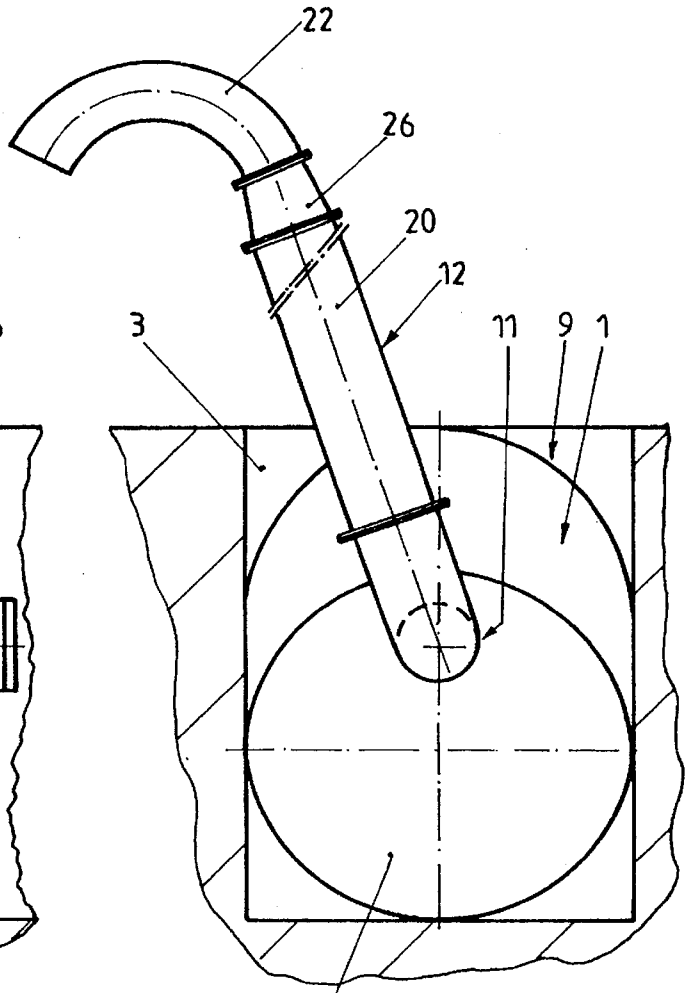
Figure 3:
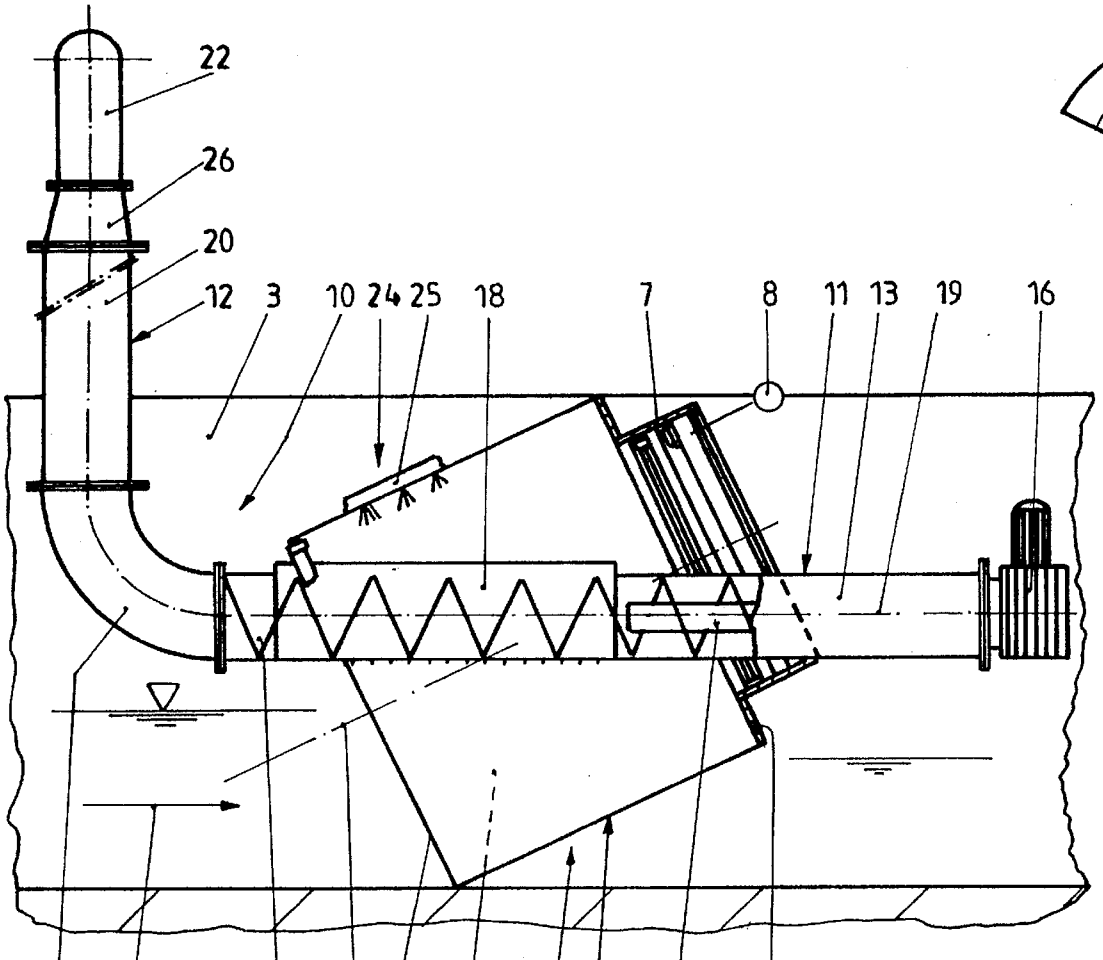

The second embodiment of the device shown in FIGS. 3 and 4 has a very similar design as the embodiment of FIGS. 1 and 2. However, here tube section 21 bridges an angle of approximately 90°, resulting in an angle of approximately 90° between the two conveyor portions 11 and 12. The housing 20 of the conveyor portion 12 may be vertically positioned, or, as seen from FIG. 4, in an inclined manner with respect to flume 3, depending on the desired discharge height, as well as jobsite installation conditions. Axes 2 and 19 may be positioned in any desired angle using a different tube end only. As far as the design is concerned, there is no dependent relationship between the conveyor assembly 10 and the separator 9 except the fact that the first conveyor portion 11 must extend through at least the interior 17 of the separation area 1, and that a part of intake chute 18 must be generally aligned under the dropping area of separation device 24.

Separator 9 may be designed in a completely different manner. The separation area 1 may be driven in rotation or may be stationary. If stationary, separation device 24 must be rotatably driven. However, if the separation area 1 is driven, the separation device 24 for removing and dropping the screened material into the direction of the conveyor portion 11 may be arranged in a fixed manner. Such a separation device 24, as seen in FIGS. 1 and 3, may comprise a nozzle bar 25 with nozzles jetting water from the outside of the separation area 1 toward the interior 17, resulting in a removal of the screened material from the inner circumferential area of the separation area 1 which then drops into the intake chute 18 of the first conveyor portion 11 of conveyor 10. Second conveyor portion 12 may comprise a conical piece with reduced diameter to form a compaction zone 26 (FIG. 3) for the collected and conveyed material. Thus, the material is compressed in addition to conveying the material to discharge container 23.

Figure 6:
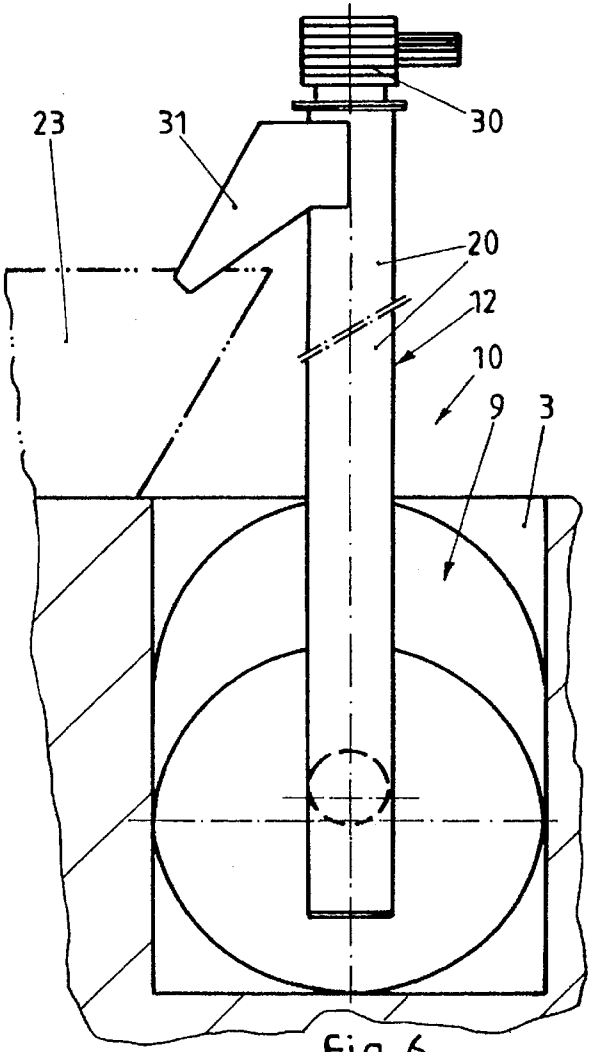
Figure 5:
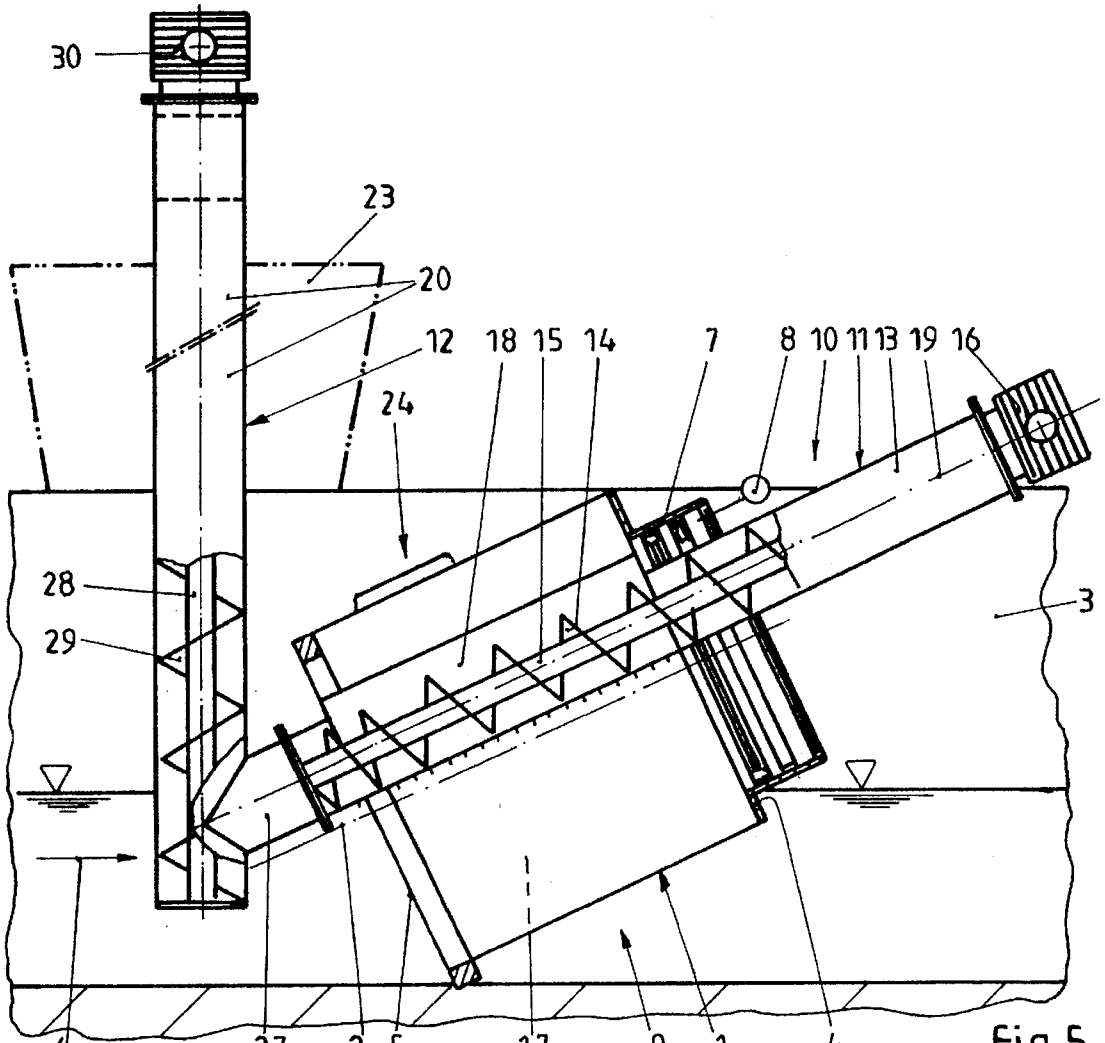

The third embodiment of FIGS. 5 and 6 shows conveyor portions 11 and 12 connected to one another by a branch 27. In addition, a shaft 28 with a conveyor screw 29 mounted thereon is rotatably supported in the housing 20 of the second conveyor portion 12, which is driven by a motor 30 mounted on top of the housing 20. Motors 16 and 30 may be operated with different running times, but will operate with respect to each other. The discharge of the conveyed material occurs through a chute 31 (FIG. 6). Axes 2 and 19 are located in a parallel and eccentric relationship to one another. Comparing the embodiments of FIGS. 3 to 6, it can be seen that, within limits, a great many possible arrangements between separator 9 and the conveyor 10 are possible.

Figure 7:
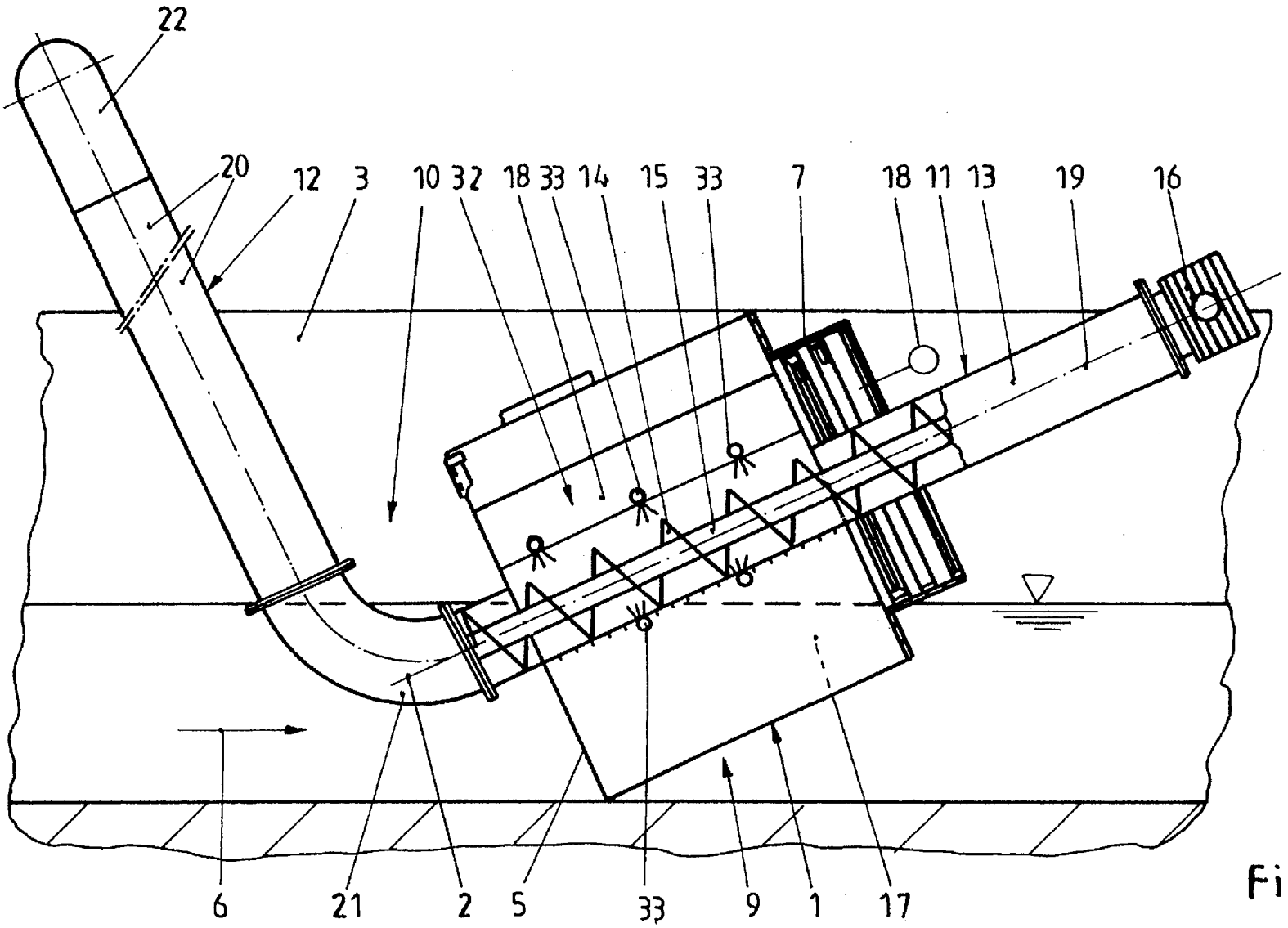

The fourth embodiment of FIG. 7 shows an arcuate tube section 21 bridging an angle of approximately 90°. If the first conveyor portion 11 with its axis 19 is located parallel to the axis 2 of the separator 9, the housing 20 of the conveyor portion 12 of the conveyor 10 will be arranged in an upwardly inclined manner extending into the flow direction, thus decreasing the dropping height from the separation device to the intake chute in minor degree compared to vertical lowering of conveyor portion 12. If the dropping height is not sufficient, it is only necessary to turn the conveyor 10 in clockwise direction with respect to the separator 9, resulting in a more angled arrangement between between the axes 2 and 19. Variation of conveyor assembly 10 is thus not necessary.

The embodiment of FIG. 7 shows the additional arrangement of a washing device 32 positioned in the region of the intake chute 18 of the first conveyor portion 11. A number of nozzles 33 are located on the wall of the intake chute 18 and on the bottom of the housing 13. The nozzles 33 are connected with a conduit for water (not shown), which may be taken out of the flume 3. The openings in the bottom of the housing 13 are adapted to the desired washing and cleaning effect of the collected material in the intake chute. The water sprayed from the nozzles 33 separates and disintegrates organic substances remaining in the liquid, thus cleaning the collected screened material. Washing device 32 may also be used in connection with the other embodiment versions of the device for removing screened material disclosed herein.

Figure 8:
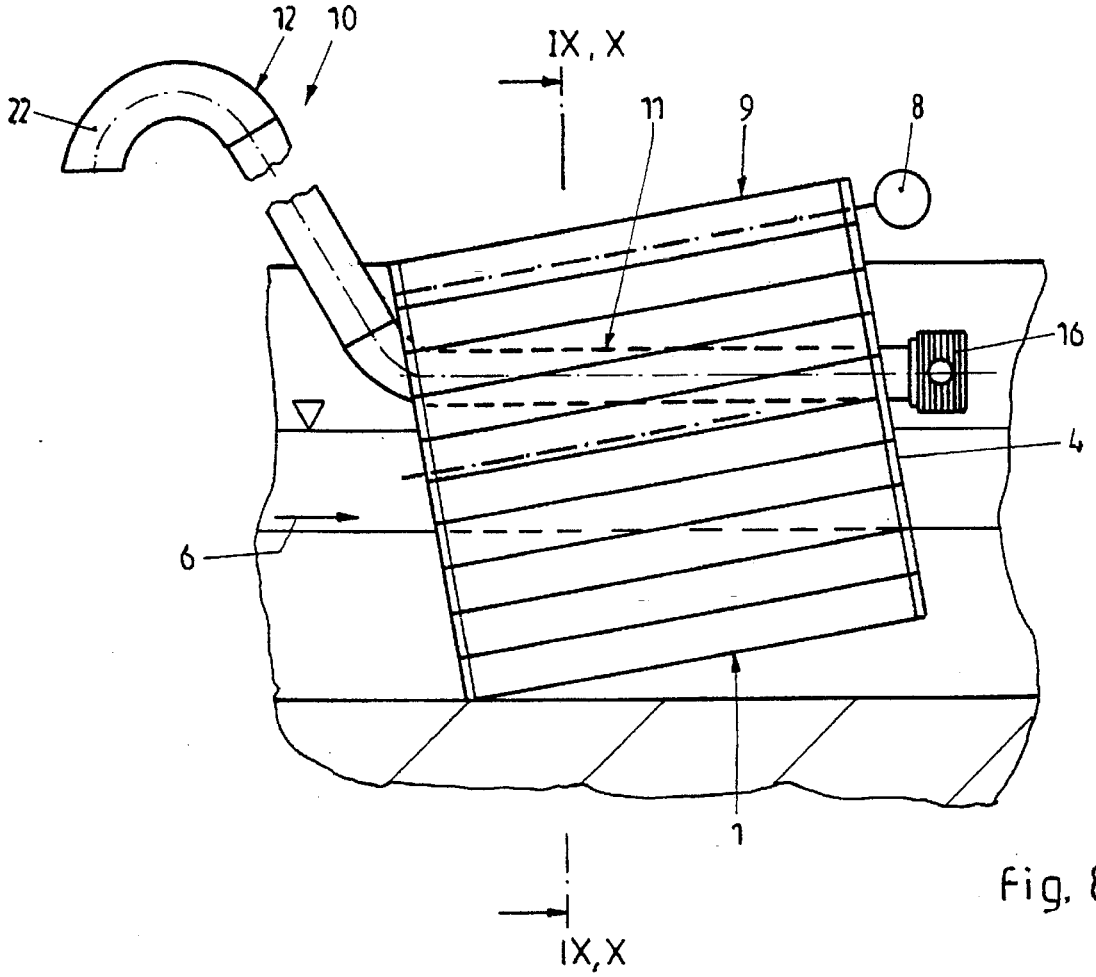
Figure 9:
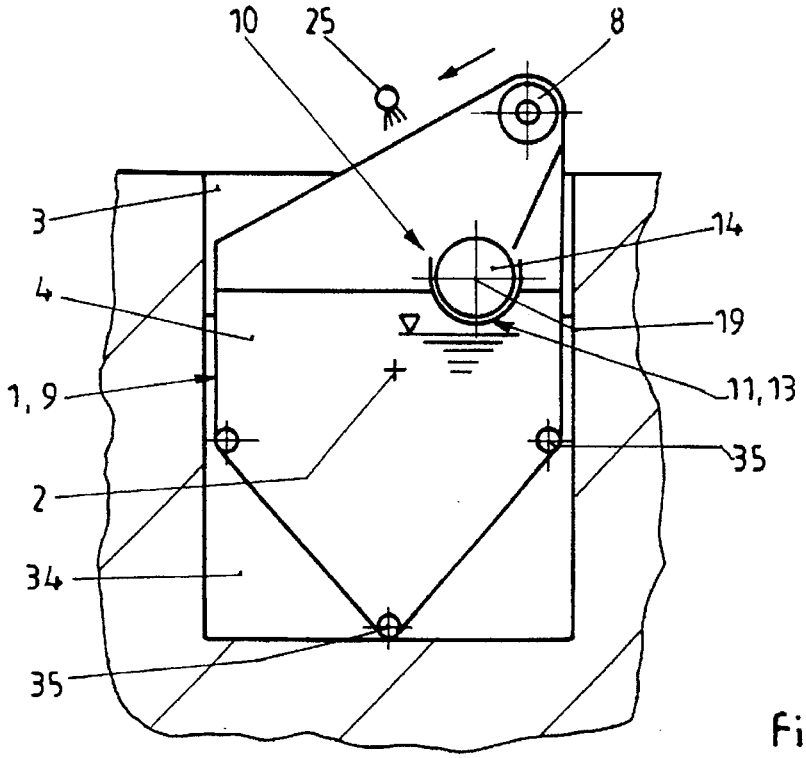
Figure 10:
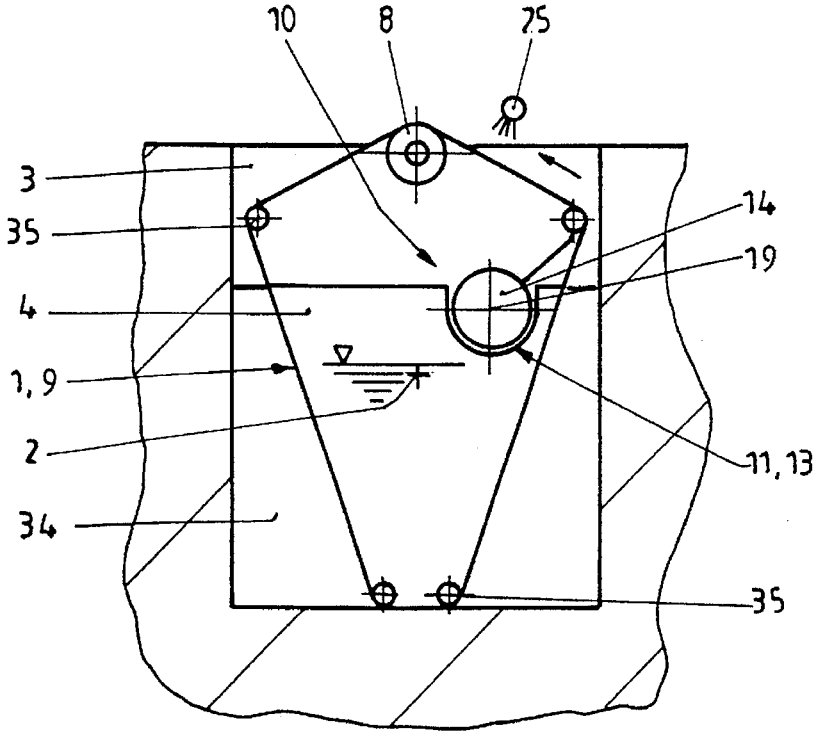

In FIG. 8 a fifth embodiment of the device is illustrated, having a polygonal separation area 1 instead of a cylindrical separation area. The separator 9 may consist of a sieve band, a chain of grating bars or the like having links, which is guided by rollers, drums, guiding plates or the like positioned in the flume 3 (see FIGS. 9 and 10). Thus, the polygonal shape of the separator 9 may be adapted to the cross-section of the flume 3 and vice versa. Advantageously, a higher velocity of the liquid in flume 3, compared with a rectangular cross-section of the flume, may be attained in the device of FIG. 7, particularly during low liquid levels, by using a V-shaped design at the bottom of flume 3 and the separator 9. Parts of the cross-section of the flume 3 may be enclosed by walls 34 of sheet steel to secure separator 9, and direct the liquid flow from the inside to the outside of the separator. These embodiments of the device again show the separate construction of separator 9 and conveyor assembly 10, neither being physically connected to one another in conventional fashion. The desired effect results from their common arrangement in the flume and the spatial relationship with respect to each other. So constructed, separator 9 and conveyor assembly 10 can be modified, assembled, and adapted to any number of flume applications and/or jobsite conditions.

Figure 11:
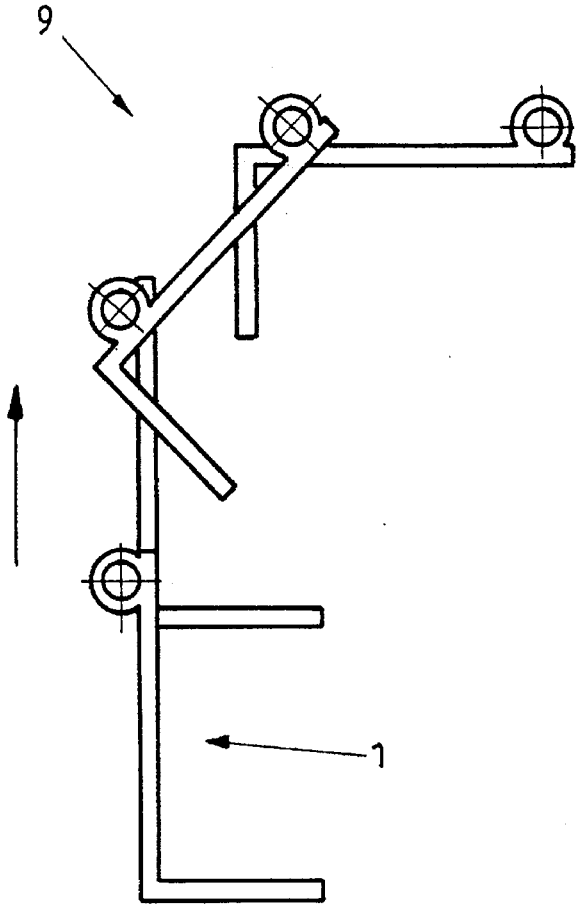
Figure 12:
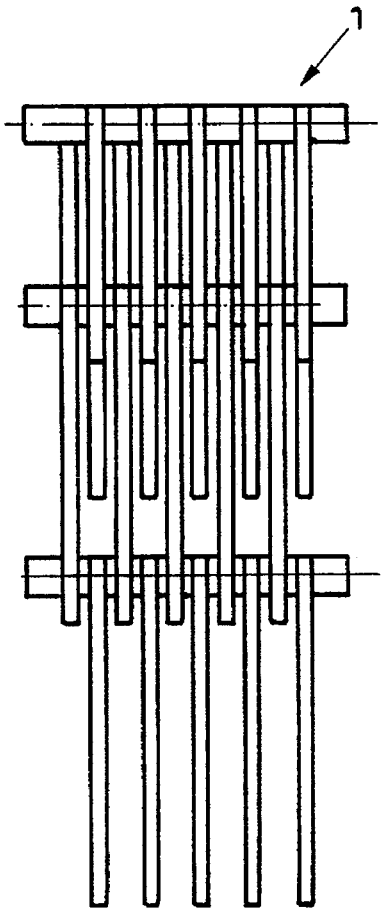

From FIGS. 11 and 12 it may be seen that an endless chain with polygonal cross-section of the separation area 1 of a separator 9 may create a selfcleaning effect. The single elements of the chain have a L-shaped design and are linked to each other. They are positioned with a small distance to each other (FIG. 12). When passing a roll or another bending point a relative motion between the single elements occurs and screened material is pushed in dropping direction.

While preferred embodiments of the invention have been disclosed in the foregoing specification, it is understood by those skilled in the art that variations and modifications thereof can be made without departing from the spirit and scope of the invention, as set forth in the following claims. Also, corresponding structures, material, acts and equivalents of means or step plus function elements in the claims below are intended to include any structure, material, or acts for performing the function in combination with other claimed elements as specifically.

We claim:

1. A device for removing floating and suspended debris from a liquid flow passing through an elongated liquid flow flume, comprising:

elongated filter means positioned within the flume at an angle with respect to the flume and extending across the path of the liquid stream for collecting floating and suspended debris in the liquid flow thereon, said filter means extending along a longitudinal axis being permeable to the liquid flow therethrough, said filter means also being at least partially submerged within the liquid flow;

elongated conveyor means supported independently of said filter means for moving debris collected by said filter means away from said filter means and out of the flume, said conveyor means having an elongated tubular housing having a first conveyor portion and a second conveyor portion, said conveyor portions being sealingly connected to one another, said first conveyor portion being positioned within said filter means and extending therefrom, said first conveyor portion having an intake chute defined therein;

a separation device positioned with respect to said filter means and said intake chute, said separation device being positioned above and aligned with said intake chute of said first conveyor portion and being constructed and arranged to loosen debris collected on said filter means so that the debris drops toward said intake chute;

said second conveyor portion including a discharge chute formed at its end opposite the end thereof connected to said first conveyor portion, said discharge chute being constructed and arranged to permit the discharge of collected debris moved through said conveyor means from said filter means.

2. The device of claim 1, wherein said conveyor means extends from said filter means in a direction against the direction of the liquid flow passing through the flume.

3. The device of claim 1, said filter means comprising a separator, said separator including an endless chain conveyor sized and shaped to remove floating and suspended debris from the fluid passed through the separator.

4. A device for removing floating and suspended debris from a liquid flow passing through an elongated liquid flow flume, comprising:

elongated filter means positioned within the flume at an angle with respect to the flume and extending across the path of the liquid stream for collecting floating and suspended debris in the liquid flow thereon, said filter means extending along a longitudinal axis being permeable to the liquid flow therethrough, said filter means also being at least partially submerged within the liquid flow;

elongated conveyor means for moving debris collected by said filter means away from said filter means and out of the flume, said conveyor means having an elongated tubular housing having a first conveyor portion and a second conveyor portion, said conveyor portions being sealingly connected to one another, said first conveyor portion being positioned within said filter means and extending therefrom, said first conveyor portion of said conveyor means supported within said filter means independently of said filter means, said first conveyor portion having an intake chute defined therein;

a separation device positioned with respect to said filter means and said intake chute, said separation device being positioned above and aligned with said intake chute of said first conveyor portion and being constructed and arranged to loosen debris collected on said filter means so that the debris drops toward said intake chute;

said second conveyor portion including a discharge chute formed at its end opposite the end thereof connected to said first conveyor portion, said discharge chute being constructed and arranged to permit the discharge of collected debris moved through said conveyor means from said filter means.

5. The device of claim 1, wherein said conveyor housing includes an arcuate tube section positioned intermediate said first and second conveyor portions, said tube section being in sealed fluid communication with said conveyor portions.

6. The device of claim 5, wherein said arcuate tube portion extends through an angle in the range of from approximately sixty degrees to ninety degrees.

7. The device of claim 1, wherein said conveyor housing includes an elongate tubular branch positioned intermediate said first and second conveyor portions, said branch being in sealed fluid communication with said conveyor portions.

8. The device of claim 1, wherein said first conveyor portion includes a conveyor screw rotatably supported therein for moving debris toward said second conveyor portion, and drive means for rotating said conveyor screw.

9. The device of claim 1, said first conveyor portion extending along a longitudinal axis, said axis being spaced from the axis of said filter means.

10. The device of claim 9, wherein said axis of the first conveyor portion is spaced eccentrically from the axis of said filter means.

11. The device of claim 9, said axis of the first conveyor portion being angled with respect to the axis of said filter means.

12. The device of claim 1, said intake chute defined within said first conveyor portion including a washing device having a plurality of liquid jets constructed and arranged to spray liquid on the collected debris dropped into said intake chute.

13. The device of claim 1, wherein said filter means is supported in a fixed position within the liquid flow flume, and said separation device is constructed and arranged to be moved along the surface of said filter means.

14. The device of claim 1, wherein said filter means is rotatably supported within the liquid flow flume, said filter means including drive means for rotating said filter means, and wherein said separation device is supported in a fixed position with respect to said filter means and is constructed and arranged to pass along the surface of said filter means as said filter means is rotated about its longitudinal axis.

15. The device of claim 1, wherein the end of said second conveyor portion opposite the end thereof connected to said first conveyor portion includes a conical section positioned adjacent said discharge chute, said conical section having a progressively decreasing diameter along its length extending toward the discharge chute.

16. The device of claim 1, wherein said second conveyor portion includes an elongated screw conveyor rotatably supported therein, said second conveyor portion being constructed and arranged to receive debris from said first conveyor portion and to move the debris toward said discharge chute, and drive means for rotating the screw conveyor of said second conveyor portion.

17. The device of claim 1, said filter means comprising a separator, said separator including a hollow cylindrical filter basket having an open end sized and shaped to allow the liquid passing through the fluid flow flume to enter into the separator, an opposed closed end, and a separator area formed within said filter basket, the filter basket being sized and shaped to remove floating and suspended debris from the fluid passed through said separator.

18. A device for removing floating and suspended material and debris from a liquid flow passing through a liquid flow flume, comprising:

elongated filter means extending downward into the flume at an angle with respect to the flume across the path of the liquid stream, and being partly submerged within the flume, for collecting floating and suspended debris from the liquid stream thereon, said filter means being shaped as an elongated tubular body formed about a central axis and being permeable to the liquid stream passing therethrough;

conveyor means positioned within the tubular body of said filter means and extending from said filter means and out of the flume for moving the debris collected by said filter means away from the filter means and for discharging the debris outside of the flume;

said conveyor means including an elongated tubular housing, an elongated conveyor screw within said housing rotatably supported along a longitudinal axis, said conveyor screw being constructed and arranged to move the collected debris toward a discharge chute formed at the end of said conveyor housing opposite the end thereof positioned within said tubular body, said conveyor housing having a first conveyor portion and a second conveyor portion in sealed liquid communication with each other;

wherein said first conveyor portion is positioned within a separation area formed within said tubular body, said first conveyor portion having an intake chute defined therein for receiving material removed from said filter means by a separation device positioned within said separation area, said separation device being spaced above and generally aligned with said intake chute;

wherein said filter means and said conveyor assembly are constructed separately of each other and have no physical connection therebetween;

drive means for said filter means;

drive means for rotating said conveyor screw, the drive means for the conveyor screw being independent of said filter drive means; and wherein said conveyor means moves the debris collected within said filter means and transferred into the conveyor means in a direction opposite to the direction of the flow of liquid passing through the liquid flow flume.

19. The device of claim 4, said filter means comprising a separator, said separator including an endless chain conveyor sized and shaped to remove floating and suspended debris from the fluid passed through the separator.

20. The device of claim 18, wherein said conveyor housing includes an arcuate tube section positioned intermediate said first and second conveyor portions, said tube section being in sealed fluid communication with said conveyor portions.

21. The device of claim 18, wherein said conveyor housing includes an elongate tubular branch positioned intermediate said first and second conveyor portions, said branch being in sealed fluid communication with said conveyor portions.

22. The device of claim 18, said first conveyor portion extending along a longitudinal axis, said axis being spaced from the axis of said filter means.

23. The device of claim 18, said intake chute defined within said first conveyor portion including a washing device having a plurality of liquid jets constructed and arranged to spray liquid on the collected debris dropped into said intake chute.

24. The device of claim 18, wherein said filter means is rotatably supported within the liquid flow flume, said drive means for said filter means rotating said filter means, and wherein said separation device is supported in a fixed position with respect to said filter means and is constructed and arranged to pass along the surface of said filter means as said filter means is rotated about its longitudinal axis.

25. The device of claim 18, wherein the end of said second conveyor portion opposite the end thereof connected to said first conveyor portion includes a conical section positioned adjacent said discharge chute, said conical section having a progressively decreasing diameter along its length extending toward the discharge chute.

26. The device of claim 18, wherein said second conveyor portion includes an elongated screw conveyor rotatably supported therein, said second conveyor portion being constructed and arranged to receive debris from said first conveyor portion and to move the debris toward said discharge chute, and drive means for rotating the screw conveyor of said second conveyor portion.

27. The device of claim 18, said filter means comprising a separator, said separator including a hollow cylindrical filter basket having an open end sized and shaped to allow the liquid passing through the fluid flow flume to enter into the separator, an opposed closed end, and a separator area formed within said filter basket, the filter basket being sized and shaped to remove floating and suspended debris from the fluid passed through said separator.

28. The device of claim 18, said filter means comprising a separator, said separator including an endless chain conveyor sized and shaped to remove floating and suspended debris from the fluid passed through the separator.

29. The device of claim 4, wherein said conveyor means extends from said filter means in a direction against the direction of the liquid flow passing through the flume.

30. The device of claim 4, said intake chute defined within said first conveyor portion including a washing device having a plurality of liquid jets constructed and arranged to spray liquid on the collected debris dropped into said intake chute.

31. The device of claim 4, wherein the end of said second conveyor portion opposite the end thereof connected to said first conveyor portion includes a conical section positioned adjacent said discharge chute, said conical section having a progressively decreasing diameter along its length extending toward the discharge chute.

32. The device of claim 4, wherein said second conveyor portion includes an elongated screw conveyor rotatably supported therein, said second conveyor portion being constructed and arranged to receive debris from said first conveyor portion and to move the debris toward said discharge chute, and drive means for rotating the screw conveyor of said second conveyor portion.

33. The device of claim 4, said filter means comprising a separator, said separator including a hollow cylindrical filter basket having an open end sized and shaped to allow the liquid passing through the fluid flow flume to enter into the separator, an opposed closed end, and a separator area formed within said filter basket, the filter basket being sized and shaped to remove floating and suspended debris from the fluid passed through said separator.

* * * * *